US011217946B2

(12) United States Patent
Nawa

(10) Patent No.: US 11,217,946 B2
(45) Date of Patent: Jan. 4, 2022

(54) CONNECTOR

(71) Applicant: Sumitomo Wiring Systems, Ltd., Yokkaichi (JP)

(72) Inventor: Tetsuo Nawa, Yokkaichi (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/983,997

(22) Filed: Aug. 3, 2020

(65) Prior Publication Data

US 2021/0044062 A1 Feb. 11, 2021

(30) Foreign Application Priority Data

Aug. 9, 2019 (JP) ..... JP2019-147247

(51) Int. Cl.

*H01R 13/627* (2006.01)
*H01R 13/703* (2006.01)
*H01R 13/635* (2006.01)
*H01R 13/639* (2006.01)

(52) U.S. Cl.

CPC ..... *H01R 13/7032* (2013.01); *H01R 13/6272* (2013.01); *H01R 13/635* (2013.01); *H01R 13/639* (2013.01)

(58) Field of Classification Search

CPC ..... H01R 13/6272; H01R 13/6275; H01R 13/465; H01R 13/641; H01R 13/635; H01R 13/639

USPC ..... 439/352, 357, 358, 488, 489

See application file for complete search history.

(56) References Cited

U.S. PATENT DOCUMENTS 5,066,244 A * 11/1991 Kato ..... H01R 13/641 439/489
5,672,073 A * 9/1997 Matsumura ..... H01R 13/641 439/188
5,848,912 A * 12/1998 Okabe ..... H01R 13/6275 439/489
5,919,056 A * 7/1999 Suzuki ..... H01R 13/6275 439/352
6,241,542 B1 * 6/2001 Nishide ..... H01R 13/7032 439/188
6,241,547 B1 * 6/2001 Fukuda ..... H01R 13/641 439/352
6,257,922 B1 * 7/2001 Shinozaki ..... H01R 13/7032 439/188
6,332,804 B2 * 12/2001 Kurimoto ..... H01R 13/629 439/188

(Continued)

FOREIGN PATENT DOCUMENTS

JP 2003-36939 2/2003
JP 2003-234152 8/2003

*Primary Examiner* — Thanh Tam T Le

(74) *Attorney, Agent, or Firm* — Gerald E. Hespos; Michael J. Porco; Matthew T. Hespos

(57) ABSTRACT

A connector is provided with a first housing and a second housing connectable to each other, a detector arranged movably to a standby position and a detection position with respect to the first housing, a pair of second terminal fittings arranged in the second housing, and a shorting terminal arranged in the second housing to short-circuit the pair of second terminal fittings. The detector includes a releasing portion for releasing a short-circuit state of the pair of second terminal fittings by the shorting terminal as the detector reaches the detection position from the standby position.

10 Claims, 18 Drawing Sheets

(56) References Cited

U.S. PATENT DOCUMENTS 6,386,898 B1 * 5/2002 Taguchi ..... H01R 13/635 439/352
6,520,786 B2 2/2003 Nakamura et al.
6,530,800 B2 * 3/2003 Nakamura ..... H01R 13/641 439/352
6,551,146 B2 * 4/2003 Nakamura ..... H01R 13/4362 439/489
6,592,398 B2 * 7/2003 Kashiyama ..... H01R 13/641 439/188
6,595,795 B2 * 7/2003 Nakamura ..... H01R 13/6271 439/352
6,602,086 B2 * 8/2003 Tsuji ..... H01R 13/6271 439/352
6,679,720 B2 * 1/2004 Nakamura ..... H01R 13/6271 439/352
6,685,500 B2 * 2/2004 Nakamura ..... H01R 13/635 439/489
6,749,455 B2 * 6/2004 Nishide ..... H01R 13/6272 439/188
6,827,596 B2 * 12/2004 Hori ..... H01R 13/6275 439/188
6,942,510 B2 * 9/2005 Nakamura ..... H01R 13/7032 439/188
7,059,902 B2 * 6/2006 Nakamura ..... H01R 13/641 439/489
7,074,069 B2 * 7/2006 Nakamura ..... H01R 13/641 439/352
7,275,951 B2 * 10/2007 Shigeta ..... H01R 13/6271 439/352
7,294,015 B2 * 11/2007 Fujii ..... H01R 13/641 439/489
7,488,197 B2 * 2/2009 Shinozaki ..... H01R 13/7031 439/489
7,530,838 B2 * 5/2009 Ohara ..... H01R 13/7031 439/489
7,591,668 B2 * 9/2009 Nakamura ..... H01R 13/641 439/489
7,618,274 B2 * 11/2009 Nakamura ..... H01R 13/641 439/188
8,851,921 B2 * 10/2014 Segawa ..... H01R 13/7031 439/489
9,379,472 B2 * 6/2016 Hara ..... H01R 13/4223
9,923,297 B2 * 3/2018 Sekino ..... H01R 13/502
10,224,671 B2 * 3/2019 Sekino ..... H01R 13/639

* cited by examiner

CONNECTOR

BACKGROUND

Field of the Invention

This disclosure relates to a connector.

Related Art

Japanese Unexamined Patent Publication No. 2003-36939 discloses a connector with a female housing and a male housing that are connectable to each other. Male terminal fittings and a shorting terminal for shorting a pair of the male terminal fittings are accommodated in the male housing. The shorting terminal includes resilient contact pieces to be brought into contact with the pair of male terminal fittings. The female housing includes a pressing portion capable of deflecting the respective resilient contact pieces on a wall of a recess.

A slider is assembled with the female housing. The slider is pushed to a rear position with respect to the female housing while the housings are being connected and is moved to a front position after the housings are connected properly. Further, when the housings are connected properly, the resilient contact pieces of the shorting terminal deflect and deform away from the respective male terminal fittings by the pressing portion, thereby releasing a short-circuit state of the respective male terminal fitting.

Proper connection of the housings can be detected by confirming a movement of the slider to the front position and can be detected electrically by the disconnection of the resilient contact pieces of the shorting terminal from the respective male terminal fittings. Japanese Unexamined Patent Publication No. 2003-234152 also discloses detection of a connected state of a connector.

The connector of Japanese Unexamined Patent Publication No. 2003-36939 is configured so that an operation of moving the slider to the front position and an operation of releasing the short-circuit state by the shorting terminal are performed independently without relating to each other. Thus, for example, if a long time elapses until mechanical detection information by the slider is obtained after electrical detection information by the shorting terminal is obtained (received) or a trouble occurs in one of the detection functions and only the other detection information is obtained, a worker cannot clearly judge that the connector has been connected properly. Thus, a reconfirmation operation is necessary and it takes time and effort.

Accordingly, it is aimed to provide a connector capable of easy connection detection.

SUMMARY

The invention relates to a connector with a first housing and a second housing that are connectable to each other. A detector is arranged movably with respect to the first housing between a standby position and a detection position. The detector can move to the detection position when the first and second housings are connected properly. Two second terminal fittings arranged in the second housing, and a shorting terminal is arranged in the second housing to short-circuit the two second terminal fittings. The detector includes a releasing portion for releasing a short-circuit state of the second terminal fittings by the shorting terminal as the detector reaches the detection position from the standby position. According to this configuration, electrical connection detection by the shorting terminal and mechanical connection detection by a movement of the detector can be performed simultaneously. Thus, judgment timings of the electrical and mechanical connection detections can be matched and the connection detections can be easily performed without any trouble.

The detector moves forward from the standby position with respect to the first housing to reach the detection position and includes two guides arranged parallel to a direction intersecting a front-rear direction. An operating portion extends between rear parts of the guides, and the releasing portion extends between front parts of the guides. According to this configuration, the rigidity of the detector can be ensured by a simple frame structure formed by the guides, the operating portion and the releasing portion.

A recess may be open in a front surface of the first housing for receiving the releasing portion, and a back surface of the recess in the first housing may serve as a restricting surface contactable by a rear end of the releasing portion when the detector is at the standby position. According to this configuration, the detector cannot move rearward from the standby position to escape from the first housing. The releasing portion has a function of preventing the escape of the detector in addition to a short-circuit releasing function. Thus, the overall structure can be simplified as compared to the case where a dedicated escape preventing function is provided.

A biasing member may be assembled with the second housing, and the biasing member may accumulate a biasing force by being pressed by the detector moving from the standby position to the detection position. If a moving operation is interrupted in the process of moving the detector toward the detection position, the detector tries to return toward the standby position by the biasing force of the biasing member. Thus, a moved state of the detector can be detected and the reliability of connection detection can be ensured even in a situation where the detector cannot be seen.

According to the present disclosure, it is possible to provide a connector capable of easy connection detection.

DETAILED DESCRIPTION

A specific example of the connector of this disclosure is described below with reference to the drawings. Note that the invention is not limited to these illustrations and is intended to be represented by claims and include all changes in the scope of claims and in the meaning and scope of equivalents.

Figure 1:
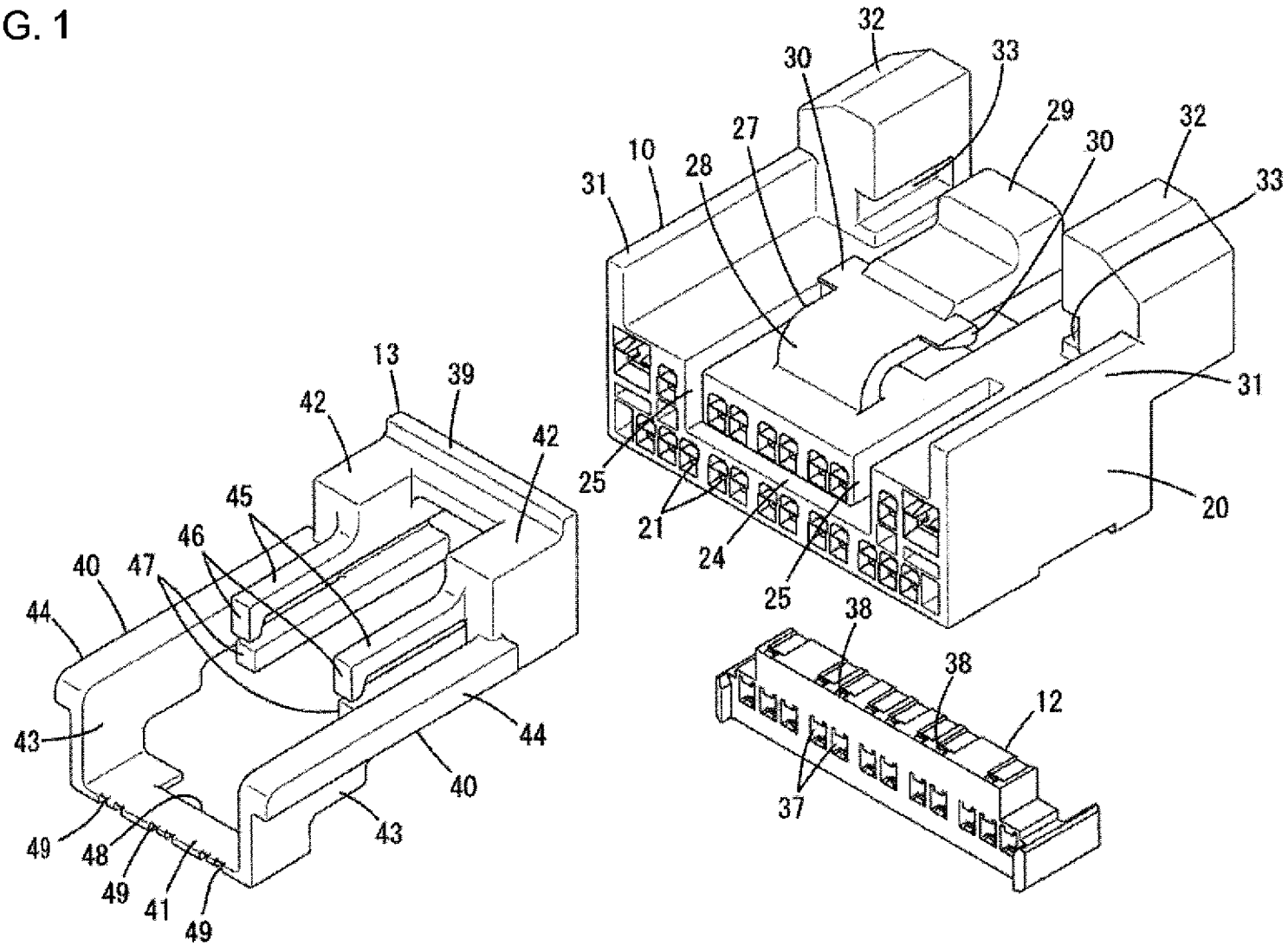
FIG. 1 is an exploded perspective view of a female connector in an embodiment.
Figure 2:
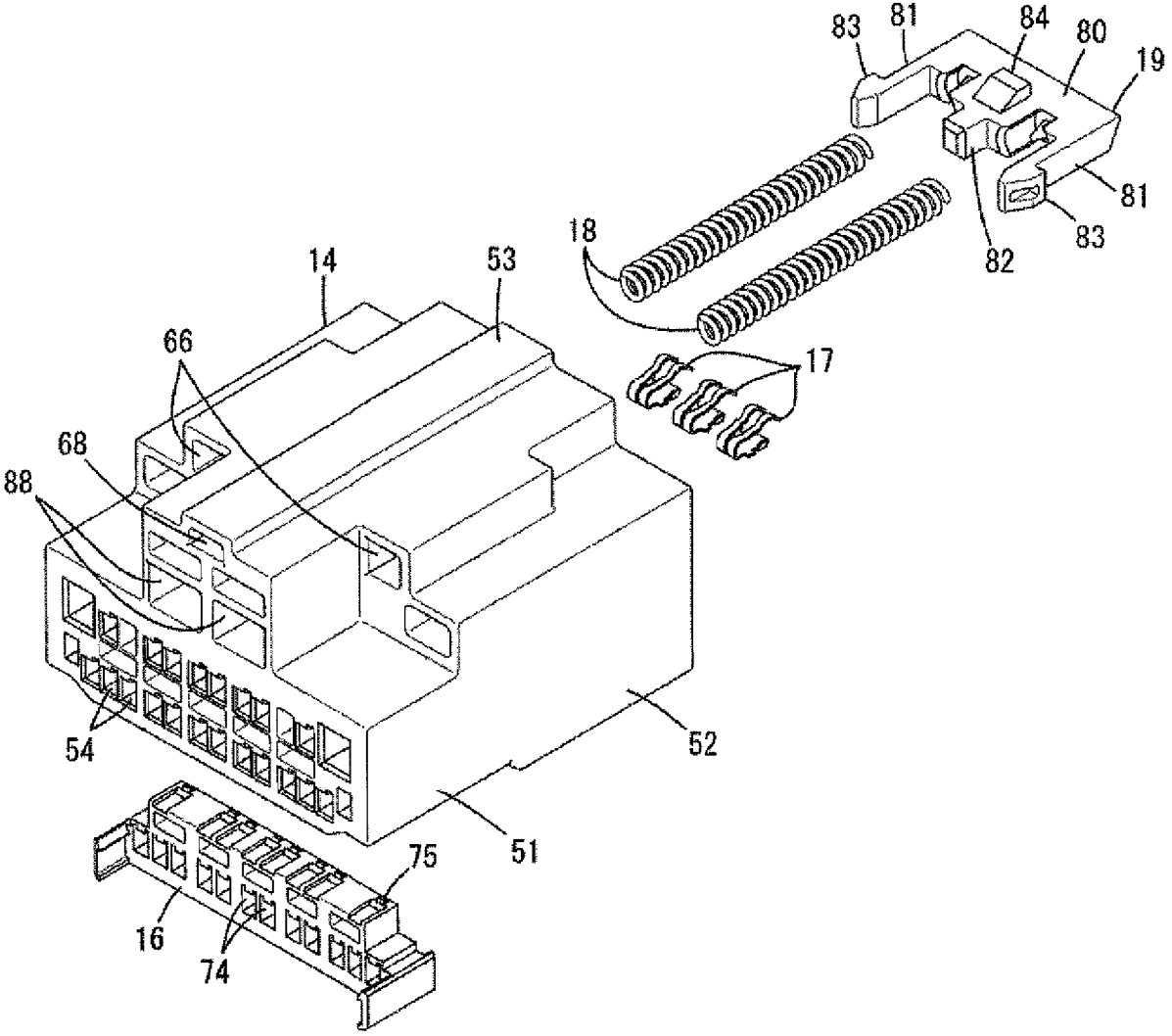
FIG. 2 is an exploded perspective view of a male connector.
Figure 16:
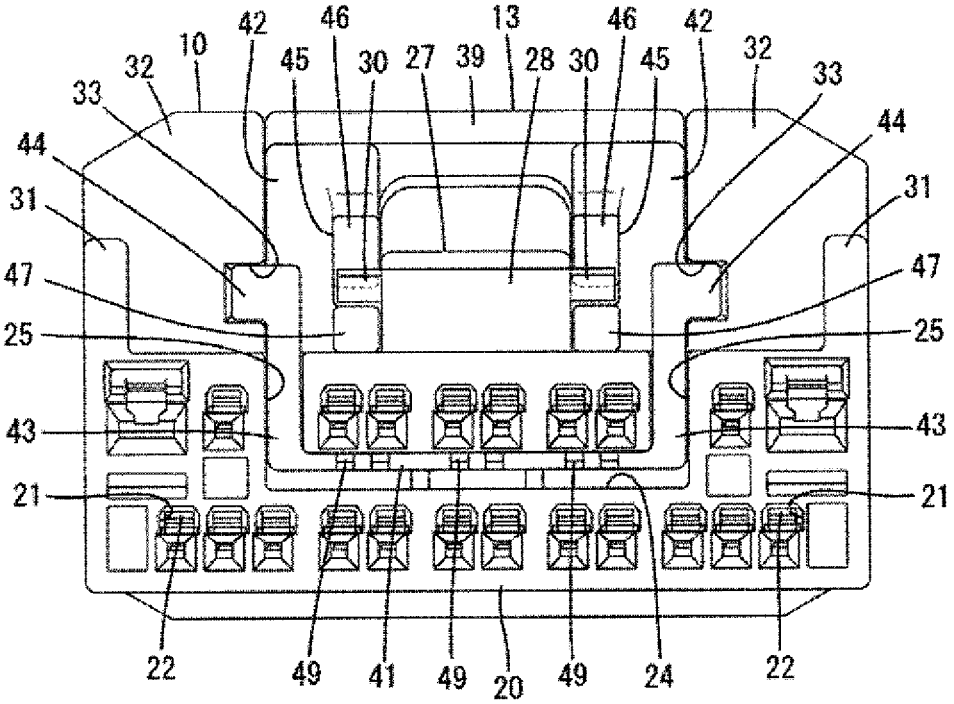
FIG. 16 is a front view showing the state where the detector is arranged at the standby position with respect to the first housing.

The connector is composed of male and female connectors connectable to each other. The female connector includes a first housing 10, first terminal fittings 11 (see FIG. 17), a first retainer 12 and a detector 13, as shown in FIG. 1. The male connector includes a second housing 14, second terminal fittings 15 (see FIG. 12), a second retainer 16, shorting terminals 17, biasing members 18 and a pressing member 19, as shown in FIG. 2. The first and second housings 10, 14 are connectable to each other. Note that, in the following description, ends facing each other when the connection of the housings 10, 14 is started are referred to as front ends concerning a front-rear direction. A vertical direction is based on a vertical direction in each figure except FIGS. 4, 6, 13 and 15. A width is equivalent to a lateral direction of FIGS. 11, 16.

First Housing 10

Figure 3:
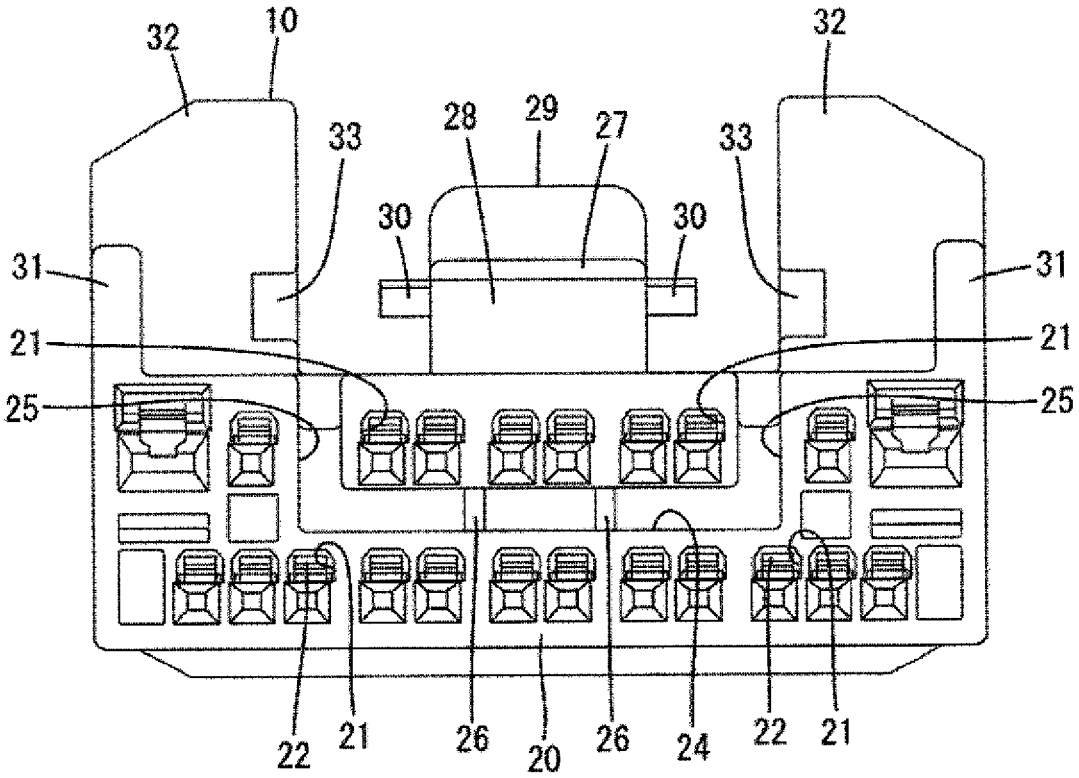
FIG. 3 is a front view of a first housing.
Figure 17:
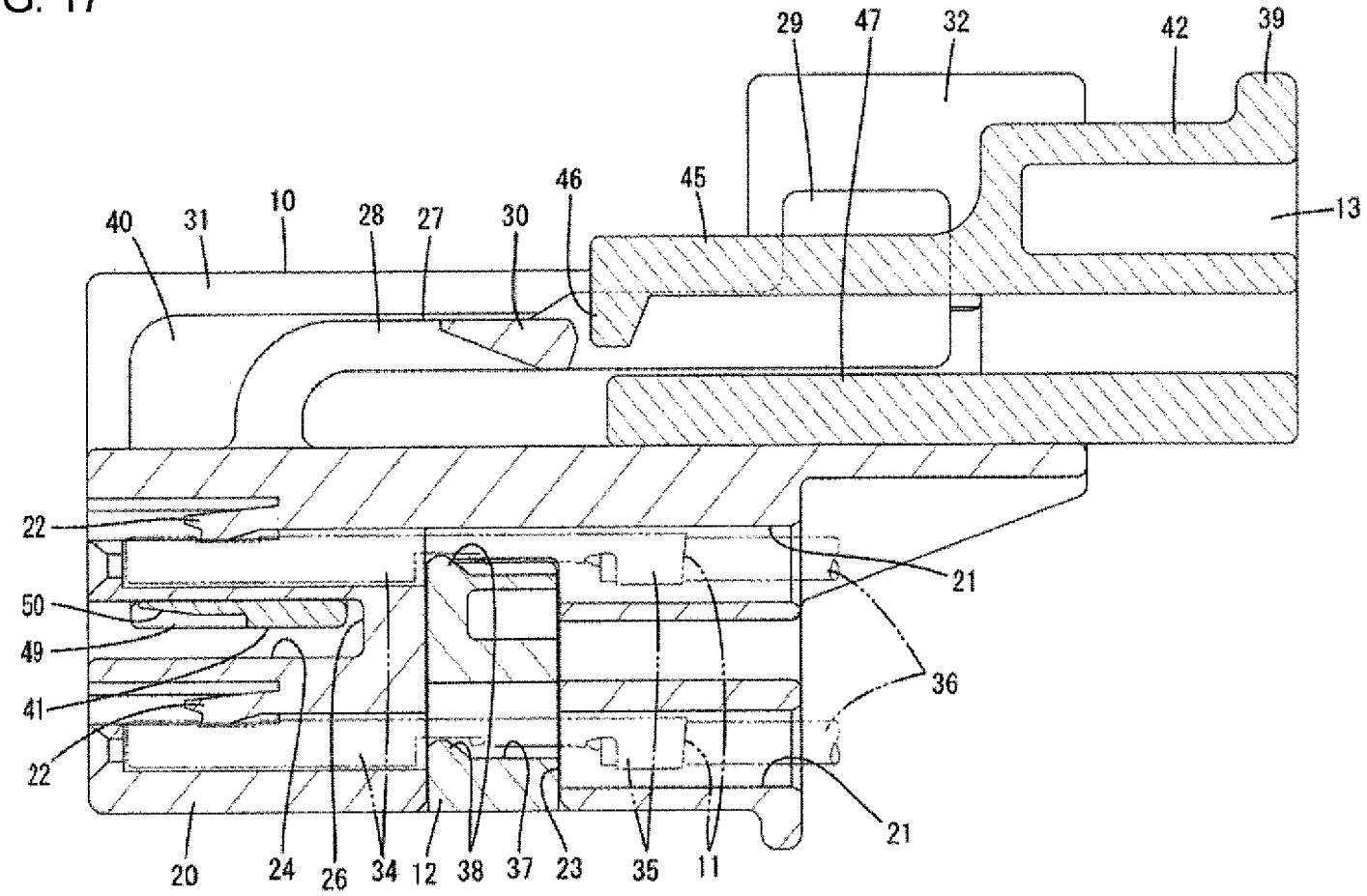
FIG. 17 is a side view in section showing the state where the detector is arranged at the standby position with respect to the first housing.

The first housing 10 is made of synthetic resin and includes, as shown in FIG. 3, a housing body 20 in the form of a rectangular block. The housing body 20 includes first cavities 21 arranged side by side in the width direction in each of upper and lower stages in the housing body 20. As shown in FIG. 17, a deflectable first locking lance 22 is provided at the upper surface of each first cavity 21. The first terminal fitting 11 is inserted into the first cavity 21 from behind and retained and locked by the first locking lance 22. The housing body 20 includes a first mounting hole 23 communicating with the upper and lower first cavities 21 and open in a lower surface. The first retainer 12 is inserted into the first mounting hole 23 from below.

As shown in FIGS. 1 and 3, the housing body 20 includes a recess 24 open in a widthwise central part of a front surface. The recess 24 defines a slit elongated in the width direction and is between the upper and lower first cavities 21 of the housing body 20. The housing body 20 includes two communicating recesses 25 extending up from both widthwise ends of the recess 24 and is open in the upper surface of the housing body 20. The recess 24 and the two communicating recesses 25 form a rectangular U shape in a front view.

The recess 24 has a back surface in front of the first mounting hole 23. As shown in FIG. 3, the housing body 20 includes two projecting ribs while being spaced apart in the width direction on the back surface of the recess 24 in a widthwise central part, and has vertically extending restricting surfaces 26 on the front surfaces of the ribs. As shown in FIG. 17, a rearward displacement of the detector 13 from the housing body 20 is restricted by the detector 13 facing the restricting surfaces 26 of the recess 24 in a state assembled with the housing body 20.

The first housing 10 includes a lock arm 27 projecting from the upper surface of the housing body 20. The lock arm 27 includes an arm body 28 extending rearward from a region between the communicating recesses 25 on the upper surface of the housing body 20. The arm body 28 is inclinable and resiliently displaceable with a base end connected to the upper surface of the housing body 20 as a fulcrum. The arm body 28 includes an unlocking portion 29 raised into a step shape on a rear part. The lock arm 27 locks the second housing 14 to hold the housings 10, 14 in a locked state (see FIG. 19) after the arm body 28 is deflected. The unlocking portion 29 is pressed when separating the housings 10, 14.

Figure 4:
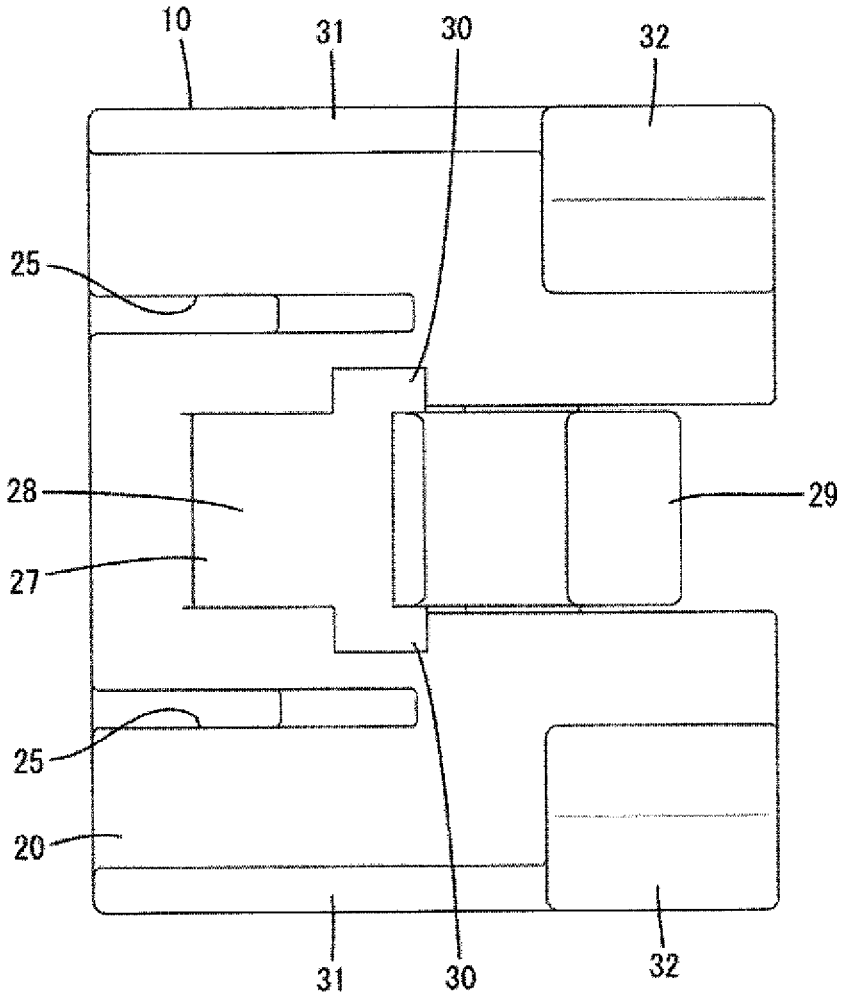
FIG. 4 is a plan view of the first housing.

As shown in FIGS. 1, 3 and 4, the lock arm 27 includes two lock pieces 30 protruding laterally from both widthwise ends of the arm body 28. The lock pieces 30 are plates and are formed in a thickness range of the arm body 28 in the vertical direction. When the arm body 28 is in a natural state, the front surfaces of the lock pieces 30 are arranged obliquely down, and the rear surfaces of the lock pieces 30 are arranged obliquely down at an angle steeper than the front surfaces (see FIG. 17 (only one of the lock pieces 30 is shown)).

The first housing 10 includes two side walls 31 rising from both widthwise ends of the upper surface of the housing body 20 and extending in the front-rear direction. As shown in FIG. 3, the side walls 31 are vertical and have a height exceeding a front part of the arm body 28. The first housing 10 includes two protection walls 32 connected to the rear ends of the side walls 31 and projecting from both widthwise end parts of a rear part of the upper surface of the housing body 20. The protection walls 32 have a height exceeding the unlocking portion 29 and prevent the interference of external matter or the like with the unlocking portion 29.

The inner facing surfaces of the protection walls 32 in the first housing 10 are recessed to form two entrance grooves 33. Each entrance groove 33 has a rectangular recessed cross-section, extends in the front-rear direction and is open in the front surfaces of the protection walls 32. The rear surfaces of the entrance grooves 33 are closed. Both protruding pieces 44 of the detector 13 to be described later can enter the entrance grooves 33 (see FIG. 15).

<First Terminal Fittings 11>

The first terminal fitting 11 is made of conductive metal and, as shown in FIG. 17, is elongated in the front-rear direction. A front part of the first terminal fitting 11 includes a box-shaped connecting portion 34 that is connected to the second terminal fitting 15. The first locking lance 22 primarily locks the upper surface of the connecting portion 34, and the first retainer 12 secondarily locks the rear surface of the connecting portion 34. The first terminal fitting 11 includes a first barrel 35 behind the connecting portion 34. The first barrel 35 is crimped and connected to a first wire 36.

<First Retainer 12>

The first retainer 12 is made of synthetic resin and, as shown in FIG. 1, has a wide shape. The first retainer 12 includes first through holes 37 that communicate respectively with the first cavities 21 in the lower stage when the first retainer 12 is inserted properly into the first mounting hole 23. As shown in FIG. 17, the first retainer 12 includes first retaining portions 38 at positions of an upper surface corresponding to the first cavities 21 in the upper stage and on the lower surfaces of the first through holes 37 corresponding to the first cavities 21 in the lower stage. The first retaining portions 38 face the rear surfaces of the respective connecting portions 34 to secondarily restrict the rearward escape of the respective first terminal fittings 11 from the first cavities 21 (see FIG. 17).

<Detector 13>

Figure 5:
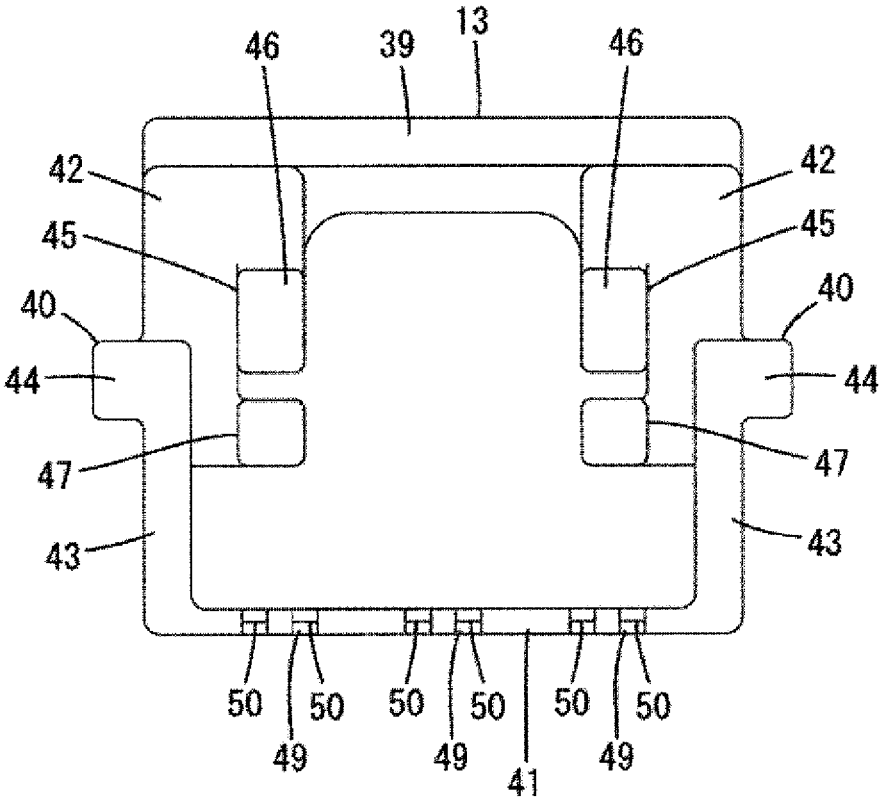
FIG. 5 is a front view of a detector.
Figure 6:
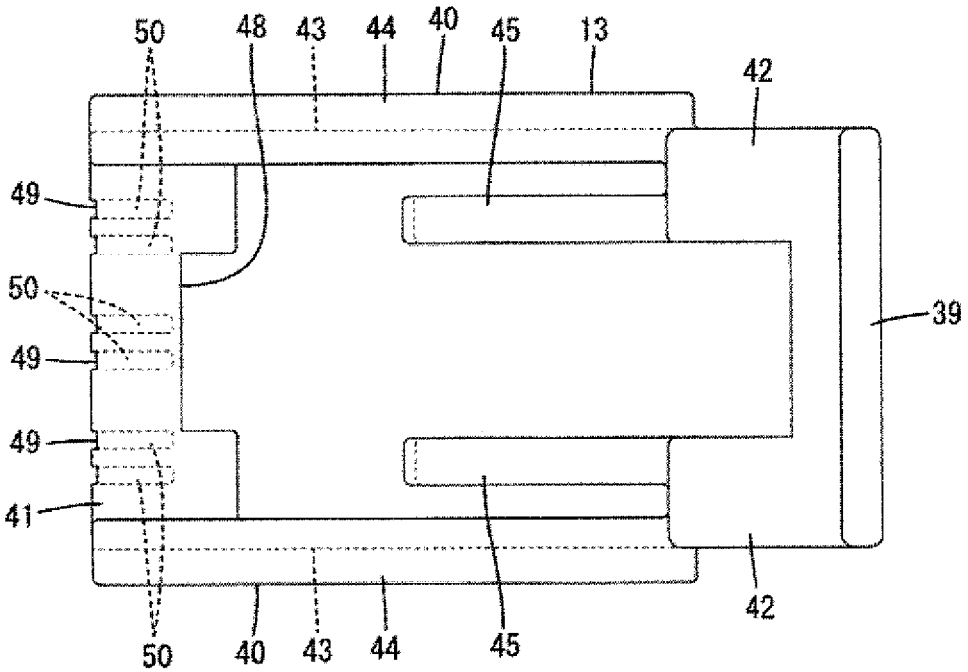
FIG. 6 is a plan view of the detector.
Figure 7:
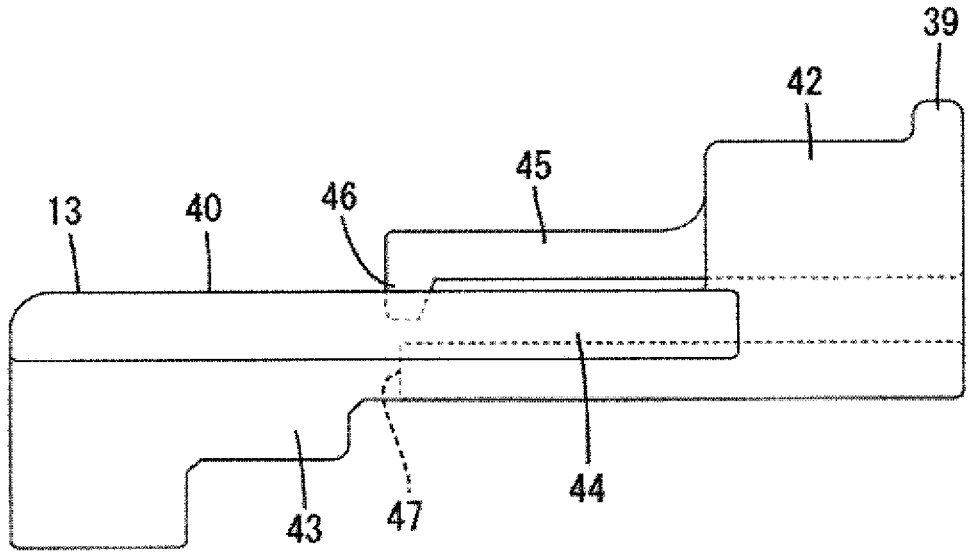
FIG. 7 is a side view of the detector.

The detector 13 is made of synthetic resin and, as shown in FIGS. 1 and 6, is in the form of a rectangular frame that has an operating portion 39 extending in the width direction, two guides 40 extending forward from both widthwise ends of the operating portion 39 and a releasing portion 41 extending in the width direction between the front ends of the guides 40. As shown in FIG. 5, the operating portion 39 is arranged higher than the releasing portion 41.

Each of the guides 40 includes a base 42 in the form of a rectangular block connected to the operating portion 39 and a plate-like guide body 43 extending forward from a widthwise end of a lower part of the base 42. The upper surfaces of the bases 42 are continuous and flush with the upper surface of the operating portion 39.

As shown in FIGS. 1 and 5, the guides 43 include the protruding pieces 44 laterally protruding from upper ends. With the detector 13 assembled with the first housing 10, the guides 43 are located in the communicating recesses 25 of the housing body 20 except the protruding pieces 44, and the protruding pieces 44 are arranged above the housing body 20 and rear parts thereof are in the entrance grooves 33 (see FIGS. 15 and 16).

As shown in FIGS. 1 and 5 to 7, two detection arms 45 extend forward from the bases 42 of the detector 13. The detection arms 45 are inward of the guide bodies 43 and are arranged above the guide bodies 43 and below the operating portion 39 in the vertical direction.

Each detection arm 45 includes a pressing portion 46 having a downward projecting part and increasing a vertical dimension on a front part. The front surfaces of the pressing portions 46 are upright end surfaces along the vertical direction. The detection arms 45 are deflectable with the front surfaces of the bases 42 as fulcrums. Further, as shown in FIGS. 1 and 5, the detector 13 includes two facing arms 47 extending forward from the bases 42 in parallel to the detection arms 45. The facing arms 47 are arranged at the same positions as the detection arms 45 in the width direction and below the detection arms 45. With the detector 13 assembled with the first housing 10, the pressing portions 46 are arranged at positions to be able to contact the lock pieces 30 of the lock arm 27 to restrict a movement of the detector 13 (see FIG. 17 (only one of the pressing portions 46 is shown)). Further, the facing arms 47 are arranged to be able to contact the upper surface of the housing body 20.

The releasing portion 41 extends between the lower ends of plate-pieces projecting down in front parts of the guide bodies 43. The releasing portion 41 is in the form of a plate extending in the width direction and has plate surfaces faced up and down. As shown in FIGS. 1 and 6, the releasing portion 41 includes a recess 48 in the form of a cutout recessed forward in a widthwise central part of a rear end. With the detector 13 assembled with the first housing 10, the releasing portion 41 is located in the recess 24 of the housing body 20 and the rib-like parts of the housing body 20 can be positioned and enter the recess 48 of the releasing portion 41.

As shown in FIGS. 1, 5 and 6, the releasing portion 41 includes releasing bodies 49 at positions spaced apart in the width direction. Each releasing body 49 includes recessed parts paired in the width direction in the lower surface of the housing body 20, and has releasing/pressing surfaces 50 in the inner surfaces of the recessed parts, as shown in FIG. 5. The releasing/pressing surface 50 of each releasing body 49 has slopes inclined up in front parts and flat parts along the front-rear direction in rear parts (see FIG. 17 (only one of the releasing/pressing surfaces 50 is shown)). The recessed parts of each releasing body 49 are open in the front surface of the housing body 20, and the front parts of the releasing/pressing surfaces 50 of each releasing body 49 are arranged to be exposed on the front surface of the housing body 20. The releasing/pressing surfaces 50 of each releasing body 49 contact both contact pieces 78 of the corresponding shorting terminal 17 to be described later to release a contact state between the contact pieces 78 and the second terminal fittings 15 corresponding to the contact pieces 78.

<Second Housing 14>

Figure 8:
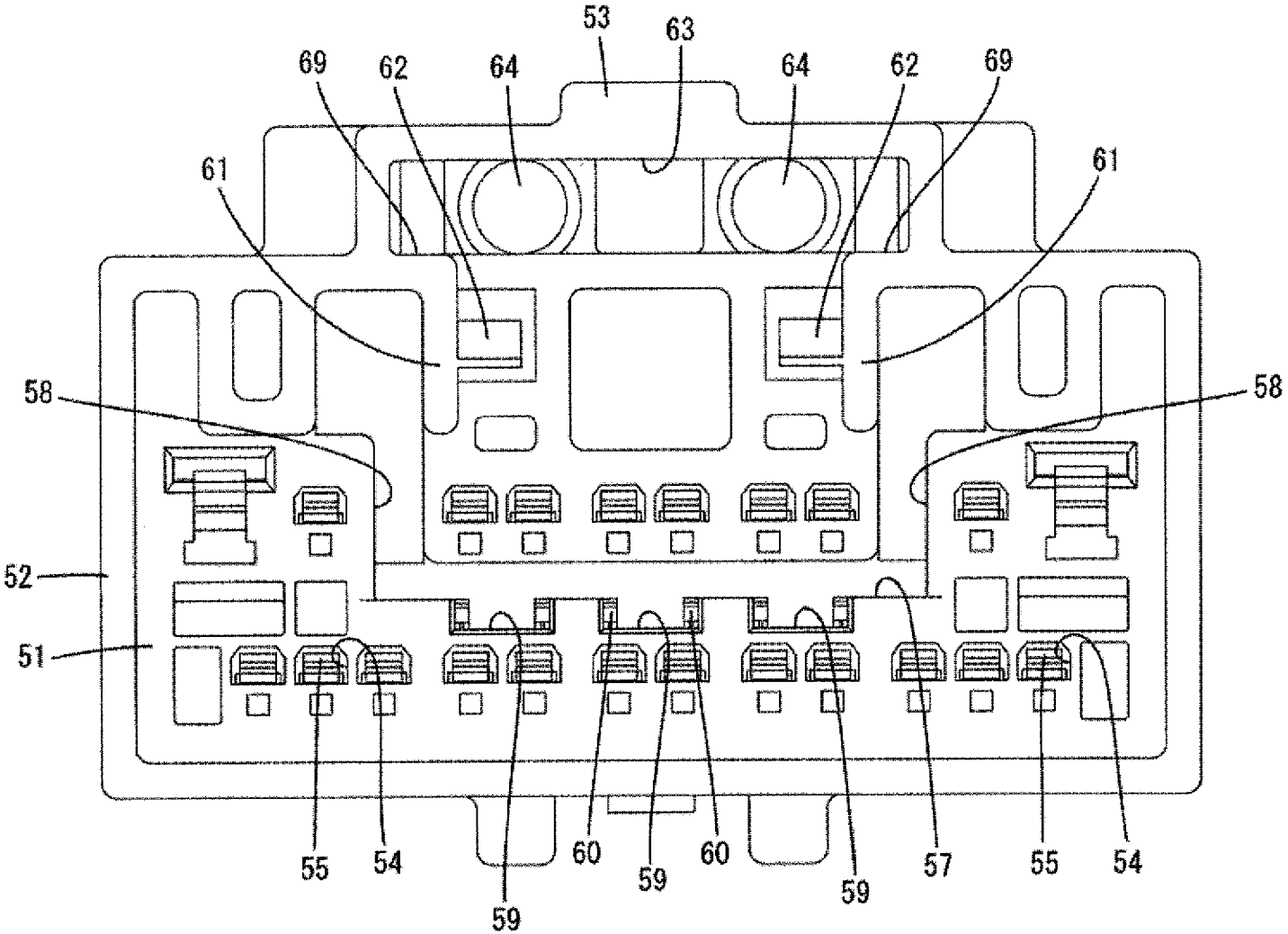
FIG. 8 is a front view of a second housing.
Figure 12:
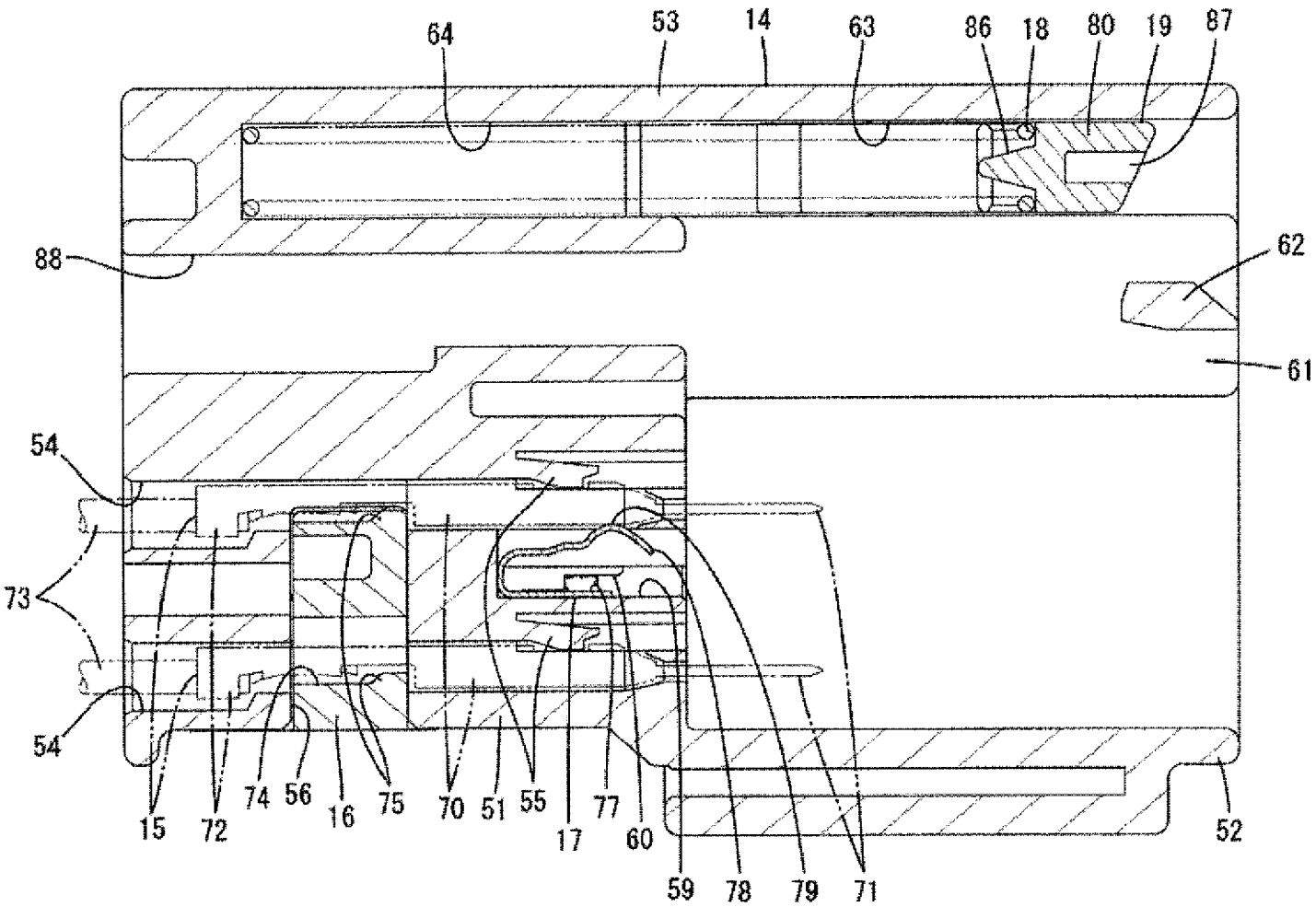
FIG. 12 is a section along X-X of FIG. 11.

The second housing 14 is made of synthetic resin and includes, as shown in FIGS. 2, 8 and 12, a terminal accommodating portion 51 in the form of a rectangular block and a receptacle 52 in the form of a rectangular tube projecting forward from the terminal accommodating portion 51. Further, the second housing 14 includes a biasing member accommodating portion 53 in a range straddling from the receptacle 52 to the terminal accommodating portion 51 in a widthwise central part of an upper part.

The terminal accommodating portion 51 includes second cavities 54 arranged side by side in the width direction in each of upper and lower stages in the terminal accommodating portion 51. As shown in FIG. 12, a deflectable second locking lance 55 is provided at the upper surface of each second cavity 54. The second terminal fitting 15 is inserted into the second cavity 54 from behind and retained and locked by the second locking lance 55. The terminal accommodating portion 51 includes a second mounting hole 56 communicating with the respective upper and lower second cavities 54 and open in a lower surface. The second retainer 16 is inserted into the second mounting hole 56 from below.

As shown in FIG. 8, the terminal accommodating portion 51 includes a facing recess 57 open in a widthwise central part of a front surface. The facing recess 57 is arranged at a position facing the recess 24 when the housings 10, 14 are connected. The facing recess 57 is in the form of a slit elongated in the width direction and formed between the respective upper and lower second cavities 54 of the terminal accommodating portion 51. The terminal accommodating portion 51 includes two communicating facing recesses 58 extending up from both widthwise ends of the facing recess 57. The facing recess 57 and the communicating facing recesses 58 form a rectangular U shape in a front view.

Figure 11:
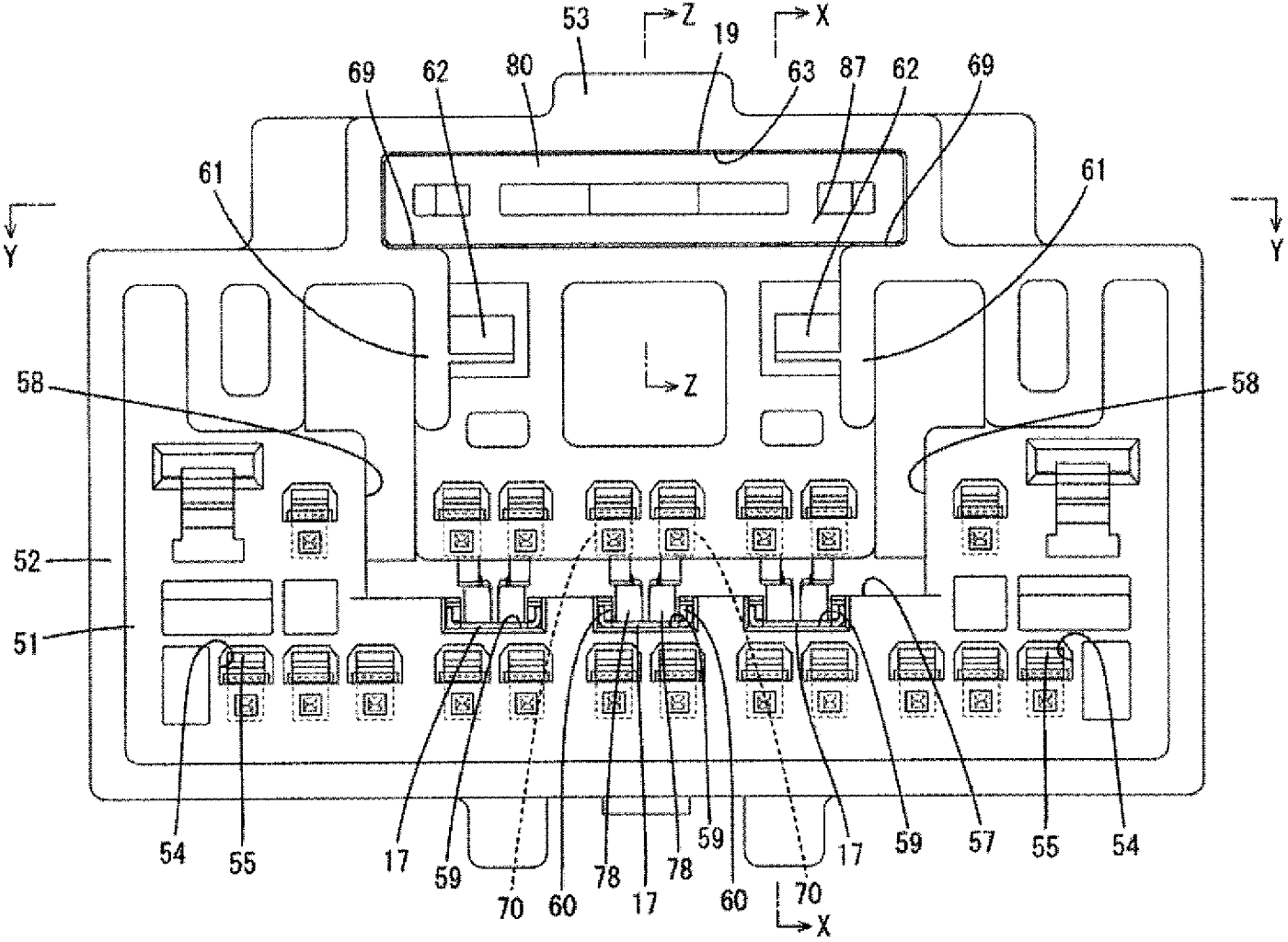
FIG. 11 is a front view of the male connector.

The terminal accommodating portion 51 includes shorting terminal inserting portions 59 at positions spaced apart in the width direction between the respective upper and lower second cavities 54. Each shorting terminal inserting portion 59 is a wide rectangular recess and is arranged at each position corresponding to the second cavities 54 paired in the width direction. Each shorting terminal inserting portion 59 communicates with the facing recess 57 and the second cavities 54 of the corresponding set (if one set is composed of the second cavities 54 paired in the width direction). As shown in FIG. 11, shorting terminals 17 are inserted respectively into the shorting terminal inserting portions 59 from the front. As shown in FIG. 8, each shorting terminal inserting portion 59 includes locking grooves 60 on both widthwise end surfaces, and later-described locking pieces 77 of the shorting terminal 17 can enter the locking grooves 60 to be locked.

As shown in FIG. 8, the receptacle 52 includes two guide walls 61 projecting down from the side of the biasing member accommodating portion 53 in a widthwise central part. The guide walls 61 are vertically long plates formed over the entire length of the receptacle 52.

As shown in FIG. 8, two lock portions 62 project in vertically central parts of the front ends of the inner facing surfaces of the guide walls 61 in the receptacle 52. The lock portions 62 are in the form of plates and the front surfaces thereof are arranged obliquely upward. Upper parts of the rear surfaces of the lock portions 62 are arranged obliquely upward at an angle steeper than the front surfaces, and lower parts thereof are arranged along the vertical direction (see FIG. 12 (only one of the locks 62 is shown)). The lock portions 62 are locked to the lock pieces 30 of the lock arm 27 (see FIGS. 19 and 20 (only one of the lock portions 62 and only one of the lock pieces 30 are shown)) when the housings 10, 14 are connected.

Figure 13:
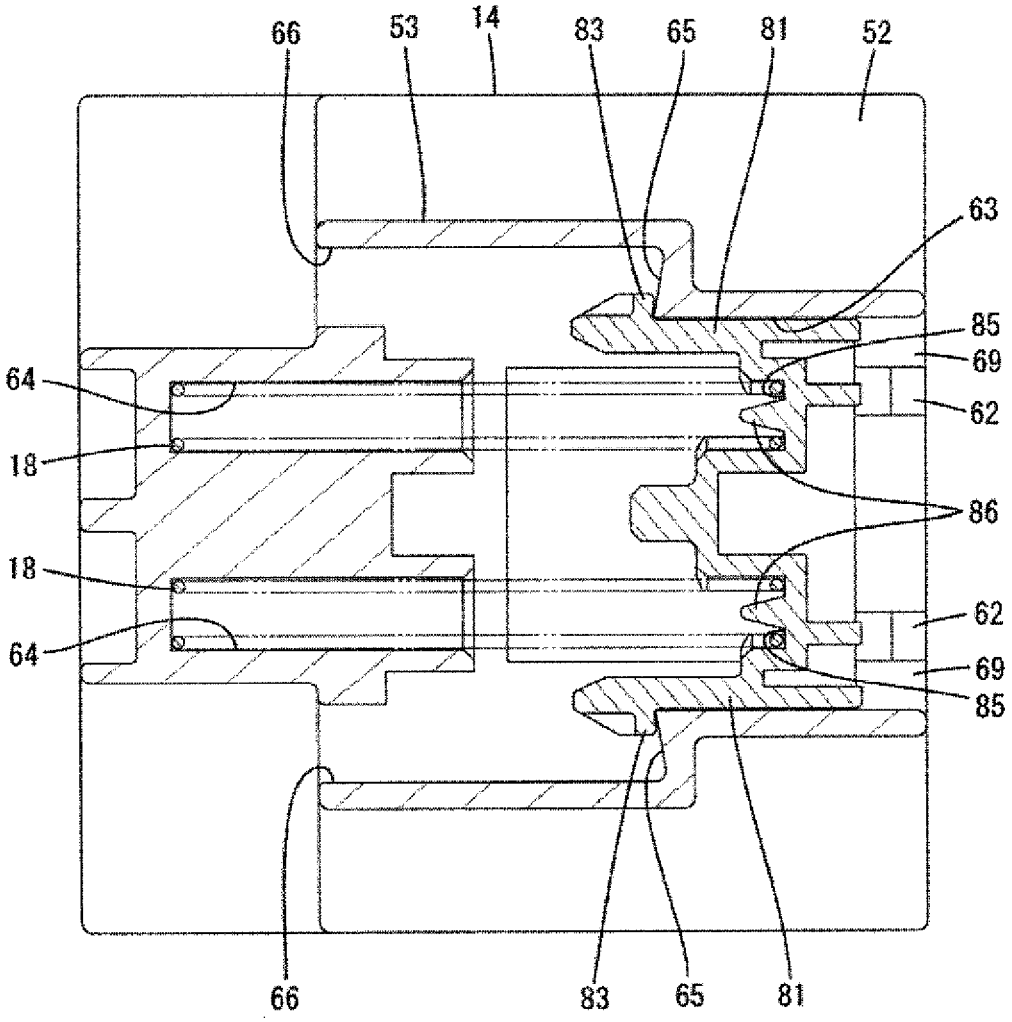
FIG. 13 is a section along Y-Y of FIG. 11.

As shown in FIG. 8, the biasing member accommodating portion 53 is a wide rectangular box with a forwardly open accommodation space 63 inside. The biasing members 18 and the pressing member 19 are accommodated in the accommodation space 63 of the biasing member accommodating portion 53. The biasing member accommodating portion 53 includes biasing member inserting portions 64 paired in the width direction in a widthwise central area of a rear part. As shown in FIGS. 8 and 13, the biasing member inserting portions 64 include circular holes extending in the front-rear direction and having front ends open to the accommodation space 63 and closed rear ends. The both biasing member inserting portions 64 include two tubular parts in the accommodation space 63 in a front end part.

As shown in FIG. 13, the biasing member accommodating portion 53 includes two lateral locking portions 65 on both widthwise ends of a front part. The lateral locking portions 65 are rearward facing surfaces and inclined forward toward widthwise outer sides. The biasing member accommodating portion 53 includes two lateral holes 66 communicating with the accommodation space 63 on both widthwise sides across the biasing member inserting portions 64. The lateral locking portions 65 can be seen from the rear surface of the biasing member accommodating portion 53 via the lateral holes 66.

Figure 14:
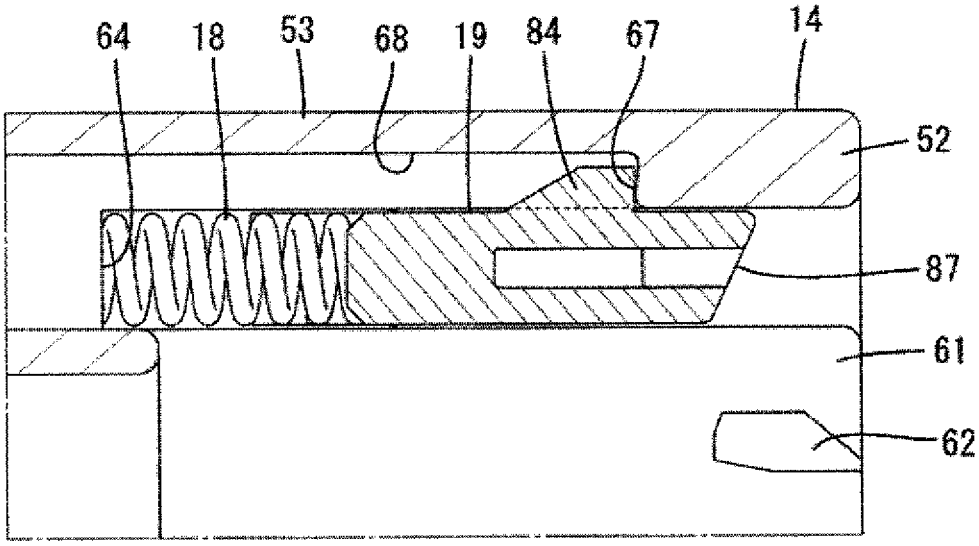
FIG. 14 is a section along Z-Z of FIG. 11.
Figure 15:
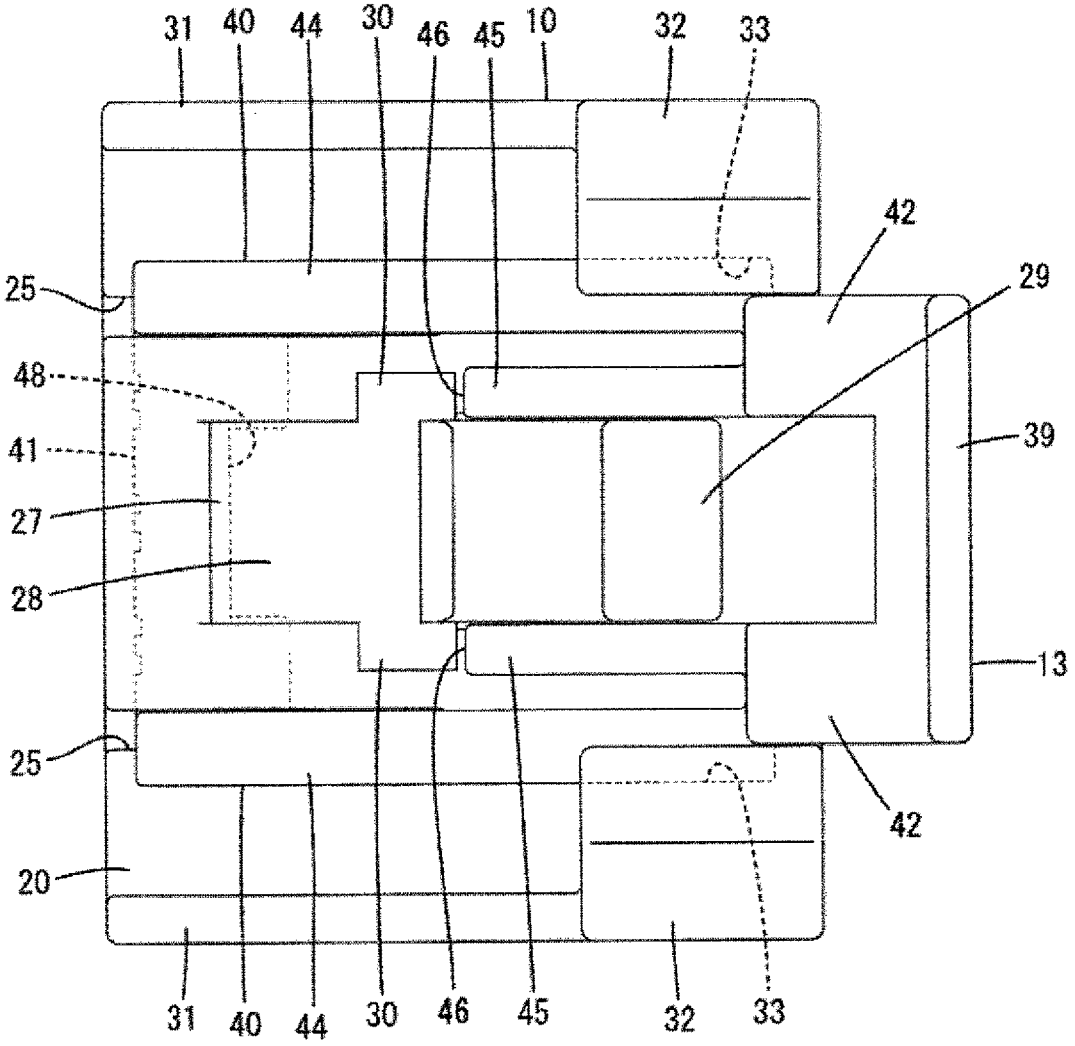
FIG. 15 is a plan view showing a state where the detector is arranged at a standby position with respect to the first housing.

The biasing member accommodating portion 53 includes an upper locking portion 67 in an upper end of the widthwise central part of the front part. As shown in FIG. 14, the upper locking portion 67 is a rearward facing surface and is inclined forward toward an upper side. The biasing member accommodating portion 53 includes a bulging part (see FIG. 2) in a widthwise central part of the upper end, and an upper hole 68 inside the bulging part. The upper locking portion 67 can be seen from the rear surface of the biasing member accommodating portion 53 via the upper hole 68. Further, as shown in FIG. 8, the biasing member accommodating portion 53 includes two supporting surfaces 69 continuous with the upper surfaces of the guide walls 61 on both widthwise sides of a lower end.

The second housing 14 includes two through holes 88 open in the rear surface below the biasing member accommodating portion 53 and behind the lock portions 62 (see FIGS. 2 and 12). The lock portions 62 can be seen from the rear surface of the second housing 14 via the through holes 88.

<Second Terminal Fittings 15>

Each second terminal fitting 15 is made of conductive metal and, as shown in FIG. 12, is elongated in the front-rear direction. Each second terminal fitting 15 includes a box-shaped terminal body 70 and a tab 71 projecting forward from the terminal body 70. The second locking lance 55 locks the upper surface of the terminal body 70, and the later-described contact piece 78 of the shorting terminal 17 resiliently contacts the lower surface of the terminal body 70. The tab 71 projects into the receptacle 52. When the housings 10, 14 are connected properly, the tabs 71 enter the connecting portions 34 and the terminal fittings 11, 15 are connected conductively (see FIGS. 19 and 20). As shown in FIG. 12, the second terminal fitting 15 includes a second barrel 72 behind the terminal body 70. The second barrel 72 is crimped and connected to a second wire 73.

<Second Retainer 16>

The second retainer 16 is made of synthetic resin and, as shown in FIG. 2, has a wide shape similar to the first retainer 12. The second retainer 16 includes second through holes 74 that communicate with the respective second cavities 21 in the lower stage when the second retainer 16 is inserted properly into the second mounting hole 56. As shown in FIG. 12, the second retainer 16 includes second retaining portions 75 at positions of an upper surface corresponding to the respective second cavities 54 in the upper stage and on the lower surfaces of the second through holes 74 corresponding to the respective second cavities 54 in the lower stage. The second retaining portions 75 face the rear surfaces of the terminal bodies 70 to secondarily restrict rearward escape of the second terminal fittings 15 from the respective second cavities 54 (see FIG. 12).

<Shorting Terminals 17>

Figure 9:
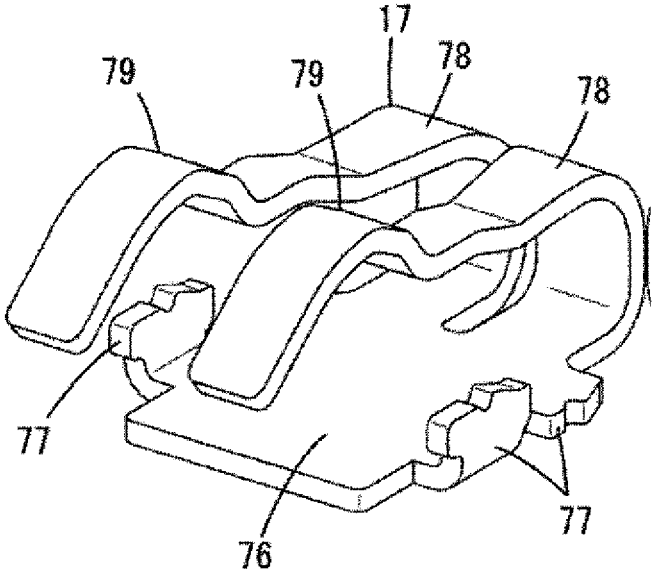
FIG. 9 is an upper front perspective view of a shorting terminal.

The shorting terminal 17 is formed integrally, such as by bending a metal plate. As shown in FIG. 9, the shorting terminal 17 includes a flat bottom plate 76, the locking pieces 77 laterally protruding from both widthwise ends of the bottom plate 76 and two of the contact pieces 78 extending forward after being curved up from both widthwise sides of the rear end of the bottom plate 76. The locking pieces 77 include flat plates protruding toward both sides in the width direction without any step in a rear part of the bottom plate 76 and bent parts projecting up after protruding toward both sides in the width direction in a front part of the bottom plate 76. Each locking piece 77 bites into a groove surface of each locking groove 60 to be locked so that the shorting terminal 17 is retained and held in the shorting terminal inserting portion 59 (see FIG. 12).

The contact pieces 78 of each shorting terminal 17 include chevron-shaped contact points 79 projecting up in rear parts. The contact points 79 of the contact pieces 78 of each shorting terminal 17 enter the second cavities 54 of each set from the facing recess 57 and contact the corresponding second terminal fittings 15. The second terminal fittings 15 are maintained in a short-circuit state via the contact pieces 78 of the shorting terminal 17.

<Biasing Members 18>

Each biasing member 18 is a resiliently deformable compression coil spring made of metal. As shown in FIG. 14, two of the biasing members 18 are provided to correspond to the biasing member inserting portions 64. The biasing members 18 are accommodated into the biasing member accommodating portion 53 with axes oriented in the front-rear direction. Rear parts of the biasing members 18 are accommodated in the biasing member inserting portions 64 and front parts thereof are supported by both supports 85 of the pressing member 19 to be described later.

<Pressing Member 19>

Figure 10:
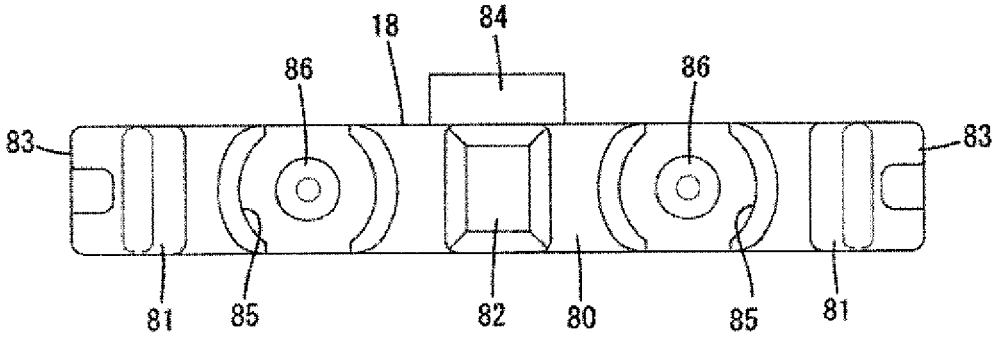
FIG. 10 is a back view of a pressing member.

The pressing member 19 is made of synthetic resin and includes, as shown in FIGS. 2 and 10, a pressing body 80 extending along the width direction, two locking arms 81 projecting rearward from both widthwise ends of the pressing body 80 and a projection 82 projecting rearward from a widthwise central part of the pressing body 80. The locking arms 81 include claw-like lateral locking projections 83 projecting outward on tip parts. A claw-like upper locking projection 84 projects on the upper surface of the pressing body 80. The lateral locking projections 83 are resiliently locked by the lateral locking portions 65. The upper locking projection 84 is locked by the upper locking portion 67. The projection 82 can enter between the tubular parts of the biasing member inserting portions 64 with the pressing member 19 accommodated in the biasing member accommodating portion 53.

As shown in FIG. 10, the two supports 85 are recessed in the width direction in the rear surface of the pressing body 80. The supports 85 have spaces for receiving the front parts of the biasing members 18 and include supporting projections 86 projecting in a positioned state into axial centers of the biasing members 18 in central parts. As shown in FIG. 12, the pressing body 80 has a pressed surface 87 inclined downward on a front surface. The pressed surface 87 is pressed by end surfaces of the pressing portions 46 in the process of moving the detector 13 (see FIG. 19).

<Connection Method and Functions of Both Connectors>

The detector 13 is assembled with the first housing 10 from the front. In the process of assembling the detector 13, the releasing portion 41 enters the recess 24, the guide bodies 43 enter the communicating recesses 25 and the pressing portions 46 pass through the lock pieces 30 while the lock arm 27 is deflected and deformed. The detector 13 is arranged such that the pressing portions 46 face the lock pieces 30 from behind (see FIG. 17), the back surface of the recess 48 of the releasing portion 41 faces the restricting surfaces 26 of the recess 24 from the front and the protruding pieces 44 face rear surfaces of the entrance grooves 33 from the front (see FIG. 15). Further, the facing arms 47 are placed along the upper surface of the housing body 20. In this way, the detector 13 is arranged in a movement restricted state at a standby position with respect to the first housing 10 (see FIGS. 15 to 17). At the standby position, the rear part of the detector 13 projects rearward from the rear surface of the first housing 10.

Further, before the housings 10, 14 are connected, the rear parts of the biasing members 18 are inserted into the holes of the biasing member inserting portions 64 from the front and the front parts thereof are arranged in an extended state in the biasing member accommodating portion 53 while being supported by the supports 85 of the pressing member 19. The pressing member 19 is arranged in a retained state in the biasing member accommodating portion 53 by the lateral locking projections 84 being locked by the lateral locking portions 65 at a position in front of the biasing member accommodating portion 53 (see FIG. 13), by the upper locking projection 84 being locked by the upper locking portion 67 (see FIG. 14) and by both widthwise end parts of the pressing member 19 being supported by the supporting surfaces 69 (see FIG. 11). A rearward displacement of the pressing member 19 is restricted by biasing forces (spring forces) of the biasing members 18.

In connecting the connectors, the first housing 10 is inserted into the receptacle 52 of the second housing 14. In the case of this embodiment, the both connectors are disposed at positions deep inside and hardly reached by a worker. Thus, a connected state of the connectors cannot be visually confirmed.

Figure 18:
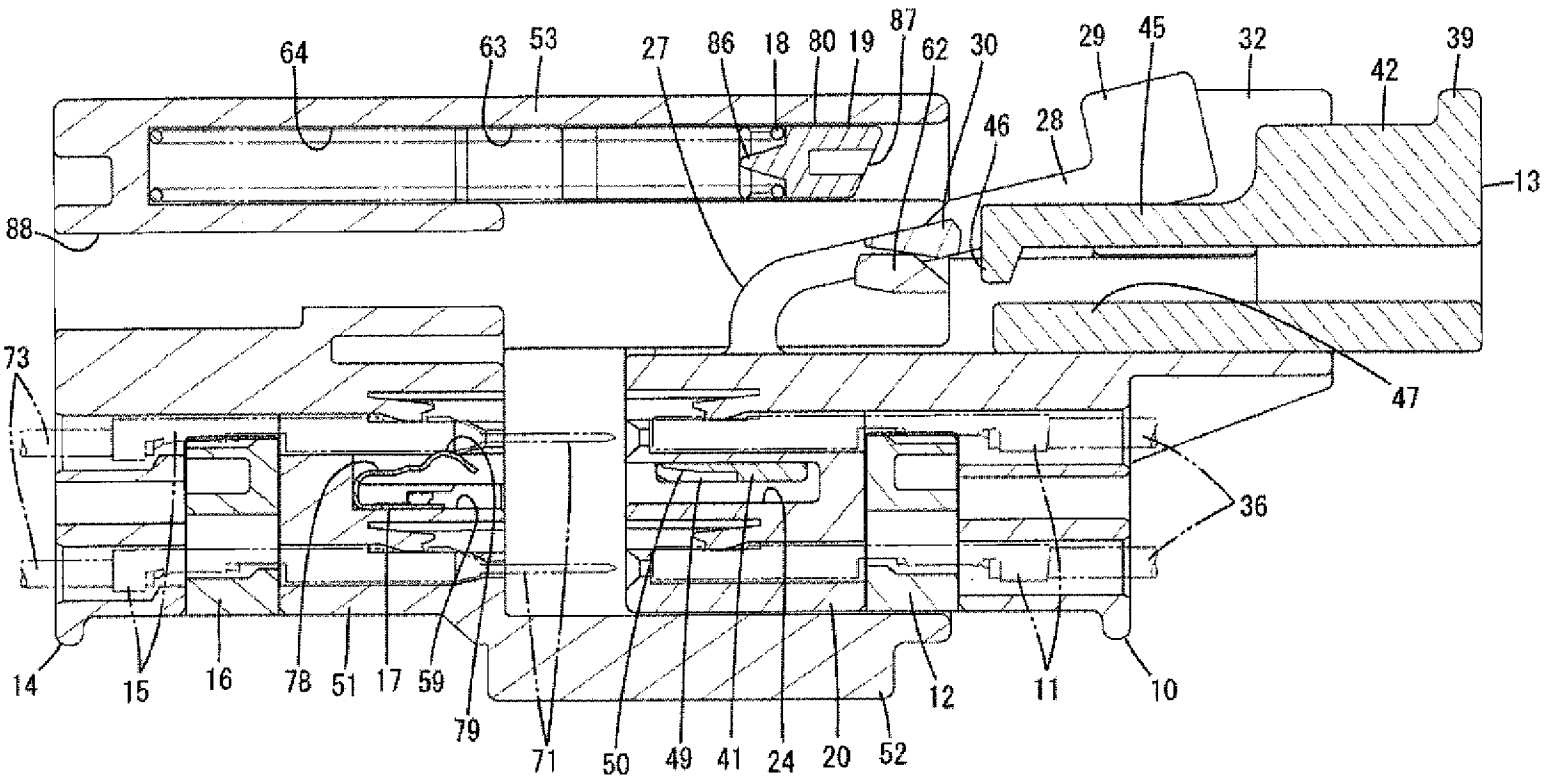
FIG. 18 is a side view in section showing a state where lock pieces of a lock arm have ridden on lock portions in the process of connecting the both housings.

When the connection of the connectors is started, each releasing body 49 faces each shorting terminal 17 and the releasing/pressing surfaces 50 of each releasing body 49 face the contact pieces 78 of each shorting terminal 17 with the releasing portion 41 arranged in the recess 24. The lock pieces 30 ride on the locks 62 after the inclined parts slide (see FIG. 18). The arm body 28 is inclined upward with the bases 42 as fulcrums as the lock pieces 30 ride on the lock portions 62. At this time, the upper parts of the pressing portions 46 face the lock pieces 30 and the lower parts thereof are arranged to face the lock portions 62. Thus, a forward (toward a detection position) movement of the detector 13 is restricted in the process of connecting the connectors.

Figure 19:
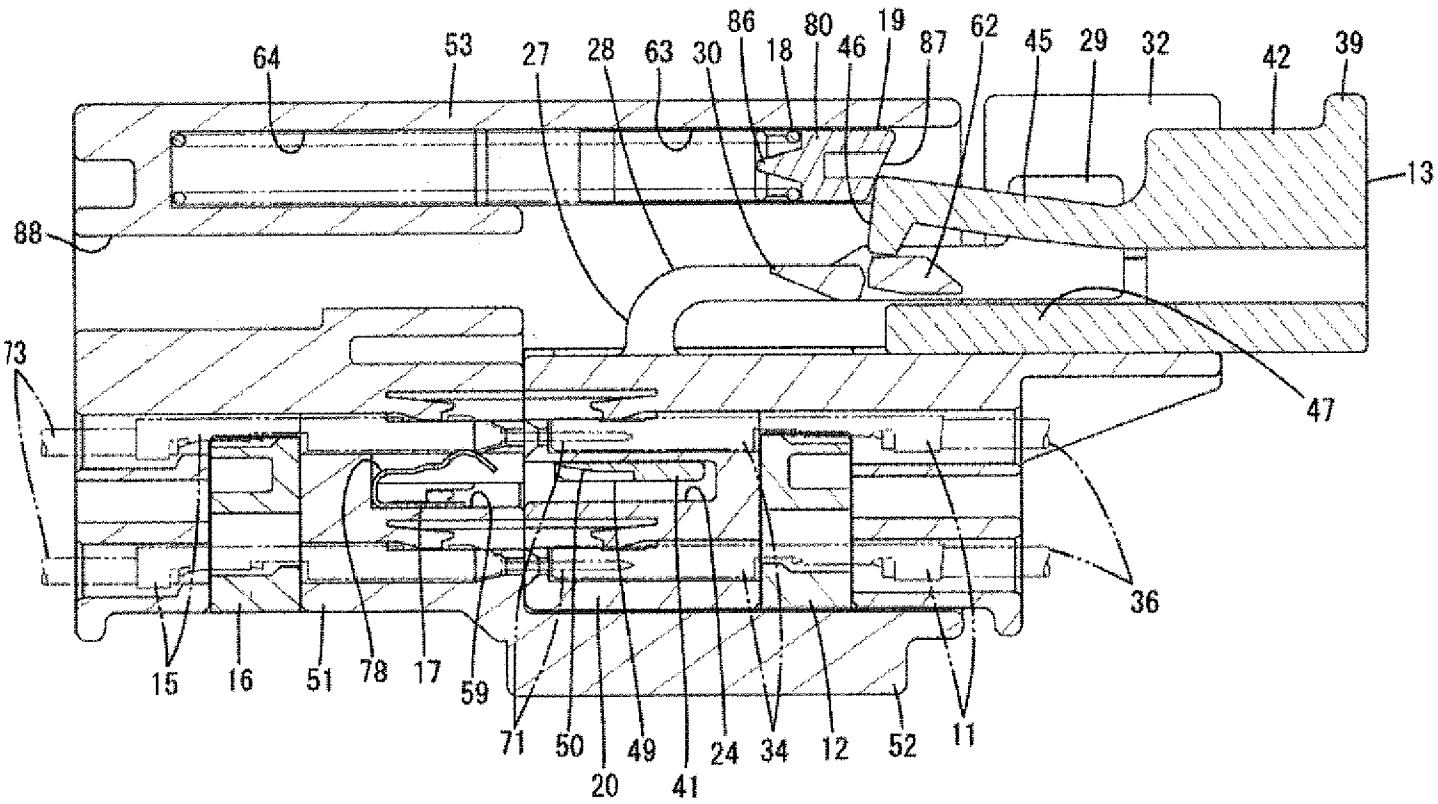
FIG. 19 is a side view in section showing a state where pressing portions press biasing members to accumulate biasing forces of the biasing members in the process of moving the detector to a detection position after the connection of the housings.
Figure 20:
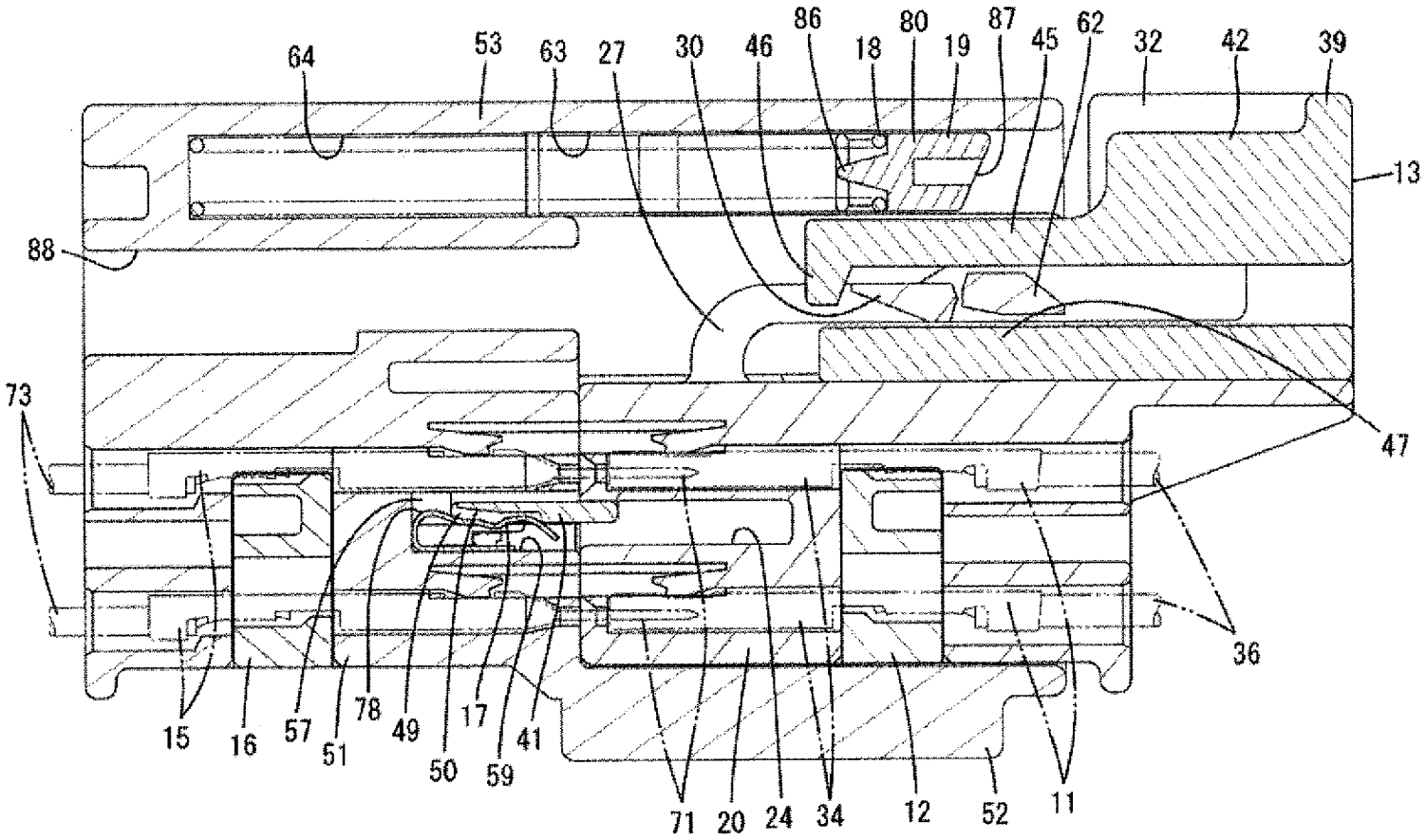
FIG. 20 is a side view in section showing a state where the detector reaches the detection position and the biasing forces of the biasing members are released after the connection of the housings.

When the housings 10, 14 are connected properly, the lock pieces 30 ride over the lock portions 62 and the arm body 28 resiliently returns to a natural state, thereby releasing an inclined state (see FIG. 19). The lock portions 62 are arranged to face and contact the lock pieces 30 from behind (behind when viewed from the first housing 10). In this way, the escape of the first housing 10 from the receptacle 52 is restricted and the housings 10, 14 are held in a connected state.

Further, if the housings 10, 14 are connected properly, the pressing portions 46 slide on the inclined parts of the lock portions 62 and ride on the upper surfaces of the lock portions 62 and the detection arms 45 are inclined upward with the bases 42 as fulcrums. In this way, the pressing portions 46 reach a height position facing the pressed surface 87 of the pressing member 19 and are disengaged from the lock pieces 30 (see FIG. 19).

After connection of the housings 10, 14, the operating portion 39 is gripped to move the detector 13 forward. The detector 13 is guided to the detection position by the facing arms 47 sliding along the upper surface of the housing body 20 and the guide bodies 43 sliding along the inner surfaces of the communicating recesses 25.

In the process of moving the detector 13, a state where the detection arms 45 are deflected and deformed is maintained and the pressing portions 46 are displaced toward the upper surfaces of the lock pieces 30 from the upper surfaces of the lock portions 62. Here, the pressing portions 46 contact the pressed surface 87 of the pressing member 19 to press the pressed surface 87 (see FIG. 19).

As the detector 13 moves, the pressing member 19 is pressed by the pressing portions 46 to move rearward against the biasing forces of the biasing members 18 and, along with that, the biasing members 18 are pressed by the pressing member 19 to be resiliently compressed. In this way, biasing forces are accumulated in the biasing members 18. The biasing forces of the biasing members 18 are transmitted to the detector 13 via the pressing member 19. Thus, if the worker interrupts a moving operation of the detector 13, the biasing forces of the biasing members 18 are released and the detector 13 tries to be displaced in a return direction toward the standby position. Thus, the worker can detect by the hand that the moving operation of the detector 13 has not been completed yet. Therefore, the moving operation of the detector 13 can be performed reliably even in a situation where the connected state of the housings 10, 14 and a moved state of the detector 13 cannot be seen.

If the detector 13 is moved farther, the pressing portions 46 transfer from the upper surfaces of the lock portions 62 to the upper surfaces of the lock pieces 30. Further, if the pressing portions 46 ride over the lock pieces 30, the detection arms 45 resiliently return to the natural state to release the inclined state. In this way, the pressing portions 46 are arranged to face the lock pieces 30 from the front and the lock pieces 30 and the lock portions 62 are arranged in a state sandwiched between the detection arms 45 and the facing arms 47 in the vertical direction (see FIG. 20).

Further, the pressing portions 46 are displaced down from the pressed surface 87 and separated from the pressing member 19 so that a pressing force acting on the pressing member 19 from the detector 13 is released and, along with that, the biasing forces of the biasing members 18 also are released. Thus, the biasing members 18 are extended resiliently to return to an initial state and the pressing member 19 returns to a front position to be locked by the lateral locking portions 65 and the upper locking portion 67. At this time, the biasing members 18 and the pressing member 19 are arranged to face the upper surfaces of the detection arms 45 and upward deflection of the detection arms 45 and the lock arm 27 is restricted. Downward deflection of the lock arm 27 is restricted by the facing arms 47. In this way, the detector 13 is arranged in the movement restricted state at the detection position with respect to the first housing 10.

In the process of moving the detector 13 toward the detection position, the releasing portion 41 partially comes out from the recess 24 and gradually projects forward from the front surface of the first housing 10. When the detector 13 reaches the detection position, the front surface of the first housing 10 is arranged to face and contact the back surface of the receptacle 52 and the releasing portion 41 (particularly, a part except the rear part) is arranged to enter the facing recess 57 (see FIG. 20). The releasing/pressing surfaces 50 of each releasing body 49 contact the contact pieces 78 of each shorting terminal 17 located in the facing recess 57 to push and tilt the contact pieces 78 and the releasing portion 41 projects between the contact pieces 78 of each shorting terminal 17 and the two second terminal fittings 15 (hereinafter, both second terminal fittings 15 of each set) corresponding to each shorting terminal 17. In this way, the contact pieces 78 of each shorting terminal 17 are separated from the second terminal fittings 15 of each set and the short-circuit state of the second terminal fittings 15 of each set is released. Thus, when the detector 13 reaches the detection position after the housings 10, 40 are connected properly, the second terminal fittings 15 of each set are set in an open state (OFF) from the short-circuit state (ON) and this can be detected as a detection signal. Further, when the detector 13 reaches the detection position, the rear part (operating portion 39 and bases 42) of the detector 13 is arranged between the protection walls 32.

On the other hand, in separating the housings 10, 14, an unillustrated jig is inserted into a clearance formed between the rear part of the detector 13 and an opening end of the receptacle 52 and the pressed surface 87 is pressed to move the pressing member 19 rearward. In this state, the detector 13 may be returned to the standby position and, further, the unlocking portion 29 may be pressed to deflect the lock arm 27, thereby releasing the locked state of the lock portions 62 and the lock pieces 30.

As described above, the arrival of the detector 13 at the detection position can be detected mechanically by the hand, utilizing the biasing forces of the biasing members 18, and can also be detected electrically, utilizing a short-circuit releasing function of the releasing portion 41. Thus, it can be reliably detected that the housings 10, 14 are in the properly connected state and the detector 13 has moved to the detection position, and the reliability of connection detection can be enhanced.

Particularly, the detector 13 includes the pressing portions 46 for pressing the biasing members 18 in the process of moving the detector 13 toward the detection position. Since the pressing portions 46 stop pressing the biasing members 18 and the biasing forces of the biasing members 18 are released when the detector 13 reaches the detection position, the biasing forces of the biasing members 18 do not act on the detector 13 at the detection position. In addition, since the deflection of the detection arms 45 is restricted by the biasing members 18 having released the biasing forces, an inadvertent return of the detector 13 toward the standby position is prevented, the deflection of the lock arm 27 can also be restricted and the connected state of the housings 10, 14 can be maintained.

Further, the releasing portion 41 collectively releases the short-circuit start of the second terminal fittings of each set by each shorting terminal 17 as the detector 13 reaches the detection position from the standby position. Thus, electrical connection detection by the shorting terminals 17 and mechanical connection detection by the detector 13 can be performed simultaneously. Therefore, judgment timings of the electrical and mechanical connection detections can be matched and connection detections are performed easily.

Further, the detecting member 13 includes the two guides 40 arranged in parallel in the width direction, the operating portion 39 is provided to extend between the rear parts of the both guides 40, the releasing portion 41 is provided between the front parts of the both guides 40, and a rectangular frame structure is formed by the both guides 40, the operating portion 39 and the releasing portion 41. Thus, the rigidity of the detector 13 is ensured by a simple structure.

Further, since the back surface of the recess 24 in the first housing 10 serves as the restricting surfaces 26 contactable by the rear end of the releasing portion 41 when the detector 13 is at the standby position, it can be prevented that the detecting member 13 moves rearward from the standby position to escape from the first housing 10.

Other Embodiments of Present Disclosure

The embodiment disclosed herein is illustrative rather than restrictive in all aspects.

For example, although the detector 13 is provided with the pressing portions 46 in the case of the above embodiment, a detector may be provided with only one pressing portion as another embodiment. Further, a detector may be provided with three or more pressing portions.

Although three shorting terminals 17 are provided and the releasing portion 41 is provided with three releasing bodies 49 to correspond to the respective shorting terminals 17 in the case of the above embodiment, only one shorting terminal may be provided and a releasing portion may be provided with only one releasing body to correspond to the shorting terminal as another embodiment. Further, two, four or more of the shorting terminals and the releasing bodies may be provided.

Although the releasing portion 41 is provided with three releasing bodies 49 to correspond to the respective shorting terminals 17 in the above embodiment, a releasing portion may be composed of one releasing body capable of collectively disengaging the respective shorting terminals as another embodiment. If the releasing portion is composed of one releasing body, only one releasing/pressing surface may be provided.

Although the first housing 10 is provided in the female connector and the second housing 14 is provided in the male connector in the above embodiment, a first housing may be provided in a male connector and a second housing may be provided in a female connector as another embodiment. In this case, the first housing includes a receptacle and accommodates male first terminal fittings including tabs inside and a detector can be assembled with the first housing. Further, the second housing includes no receptacle and accommodates female second terminal fittings including connecting portions inside, and a biasing member can be assembled with the second housing.

Although the pressing portion 46 of the detector 13 resiliently deforms the biasing member 18 via the pressing member 19 in the above embodiment, a pressing portion of a detector may directly resiliently deform a biasing member.

Although the biasing member 18 is accommodated in the second housing 14 with which the detector 13 is assembled, in the above embodiment, a biasing member may be accommodated in a first housing, with which a detector is assembled.

LIST OF REFERENCE SIGNS

10 . . . first housing
11 . . . first terminal fitting
12 . . . first retainer
13 . . . detector
14 . . . second housing
15 . . . second terminal fitting
16 . . . second retainer
17 . . . shorting terminal
18 . . . biasing member
19 . . . pressing member
20 . . . housing body
21 . . . first cavity
22 . . . first locking lance
23 . . . first mounting hole
24 . . . recess
25 . . . communicating recess
26 . . . restricting surface
27 . . . lock arm
28 . . . arm body
29 . . . unlocking portion
30 . . . lock piece
31 . . . side wall
32 . . . protection wall
33 . . . entrance groove
34 . . . connecting portion
35 . . . first barrel
36 . . . first wire
37 . . . first through hole
38 . . . first retaining portion
39 . . . operating portion
40 . . . guide
41 . . . releasing portion
42 . . . base
43 . . . guide body
44 . . . protruding piece
45 . . . detection arm
46 . . . pressing portion
47 . . . facing arm
48 . . . recess
49 . . . releasing body
50 . . . releasing/pressing surface
51 . . . terminal accommodating portion
52 . . . receptacle
53 . . . biasing member accommodating portion
54 . . . second cavity
55 . . . second locking lance
56 . . . second mounting hole
57 . . . facing recess
58 . . . communicating facing recess
59 . . . shorting terminal inserting portion
60 . . . locking groove
61 . . . guide wall
62 . . . lock portion
63 . . . accommodation space
64 . . . biasing member inserting portion
65 . . . lateral locking portion
66 . . . lateral hole
67 . . . upper locking portion
68 . . . upper hole
69 . . . supporting surface
70 . . . terminal body
71 . . . tab portion
72 . . . second barrel portion
73 . . . second wire
74 . . . second through hole
75 . . . second retaining portion
76 . . . bottom plate portion
77 . . . locking piece
78 . . . contact piece
79 . . . contact point portion
80 . . . pressing body
81 . . . locking arm
82 . . . projecting portion
83 . . . lateral locking projection
84 . . . upper locking projection
85 . . . supporting portion
86 . . . supporting projection
87 . . . pressed surface
88 . . . through hole

What is claimed is:

1. A connector, comprising:

a first housing and a second housing connectable to each other;

a detector having opposite front and rear ends and being arranged movably to a standby position and a detection position with respect to the first housing, the detector being allowed to move to the detection position when the first and second housings are connected properly;

two second terminal fittings arranged in the second housing; and a shorting terminal arranged in the second housing to short-circuit the second terminal fittings, the detector including an operating portion at the rear end of the detector, two laterally spaced guides projecting forward from the operating portion toward the front end of the detector, and a releasing portion extending between and connecting the guides at the front end of the detector so that the operating portion, the guides and the releasing portion define a frame shape, the releasing portion being disposed and configured for releasing a short-circuit state of the second terminal fittings by the shorting terminal as the detector reaches the detection position from the standby position, wherein:

a recess into which the releasing portion enters is open in a front surface of the first housing, and a back surface of the recess in the first housing defining a restricting surface contactable by a rear end of the releasing portion when the detector is at the standby position.

2. The connector of claim 1, wherein:

the two guides are parallel to a front-rear direction.

3. The connector of claim 1, further comprising two detection arms projecting forward from the operating portion at positions on the operating portion laterally inward of the guides.

4. A connector, comprising:

a first housing having a forwardly open recess, a back surface of the recess in the first housing defining a restricting surface;

a second housing connectable to the first housing, two second terminal fittings and a shorting terminal arranged in the second housing, the shorting terminal arranged in the second housing to short-circuit the second terminal fittings;

a detector arranged in the first housing and being movable forward from a standby position to a detection position with respect to the first housing, the detector being allowed to move to the detection position when the first and second housings are connected properly, the detector includes two guides arranged in parallel in a direction intersecting a front-rear direction, an operating portion extending between rear parts of the guides, and a releasing portion extending between front parts of the guides, the releasing portion releasing a short-circuit state of the second terminal fittings by the shorting terminal as the detector reaches the detection position from the standby position, the releasing portion contacting the restricting surface when the detector is at the standby position, wherein:

a biasing member is assembled with the second housing, and the biasing member accumulates a biasing force by being pressed by the detector moving from the standby position to the detection position.

5. A connector, comprising:

a first housing and a second housing connectable to each other;

a detector having opposite front and rear ends and being arranged movably to a standby position and a detection position with respect to the first housing, the detector being allowed to move to the detection position when the first and second housings are connected properly;

two second terminal fittings arranged in the second housing; and a shorting terminal arranged in the second housing to short-circuit the second terminal fittings, the detector including an operating portion at the rear end of the detector, two laterally spaced guides projecting forward from the operating portion toward the front end of the detector, two detection arms projecting forward from the operating portion at positions on the operating portion laterally inward of the guides, and a releasing portion extending between and connecting the guides at the front end of the detector so that the operating portion, the guides and the releasing portion define a frame shape, the releasing portion being disposed and configured for releasing a short-circuit state of the second terminal fittings by the shorting terminal as the detector reaches the detection position from the standby position, wherein:

a biasing member is assembled with the second housing, and the biasing member accumulates a biasing force by being pressed by the detector moving from the standby position to the detection position.

6. The connector of claim 5, wherein:

a recess into which the releasing portion enters is open in a front surface of the first housing, and a back surface of the recess in the first housing defining a restricting surface contactable by a rear end of the releasing portion when the detector is at the standby position.

7. A connector, comprising:

a first housing and a second housing connectable to each other;

a detector having opposite front and rear ends and being arranged movably to a standby position and a detection position with respect to the first housing, the detector being allowed to move to the detection position when the first and second housings are connected properly;

two second terminal fittings arranged in the second housing; and a shorting terminal arranged in the second housing to short-circuit the second terminal fittings, the detector including an operating portion at the rear end of the detector, two laterally spaced guides projecting forward from the operating portion toward the front end of the detector, two detection arms projecting forward from the operating portion at positions on the operating portion laterally inward of the guides, and a releasing portion extending between and connecting the guides at the front end of the detector so that the operating portion, the guides and the releasing portion define a frame shape, the releasing portion being disposed and configured for releasing a short-circuit state of the second terminal fittings by the shorting terminal as the detector reaches the detection position from the standby position, wherein each of the guides has opposite upper and lower surfaces spaced apart in a vertical direction, the detection arms projecting forward from positions on the operating portion above the guides in the vertical direction.

8. The connector of claim 7, wherein the releasing portion is lower than the detection arms in the vertical direction.

9. The connector of claim 7 were in the releasing portion is aligned with the lower surfaces of the guides and is lower than the upper surfaces of the guides.

10. The connector of claim 7, wherein the second housing includes lock portions and the first housing includes a resiliently deflectable lock arm with lock pieces that engage rear sides of the lock portions on the second housing when the first and second housings are connected, the detector further comprising facing arms projecting forward from the operating portion at positions vertically below the detection arms, the detection arms and the facing arms sandwiching the lock pieces and the lock portions from upper and lower sides when the detector is at the detection position.

* * * * *